United States Patent [19]

Kristiansen et al.

[11] 4,286,773

[45] Sep. 1, 1981

[54] METALLURGICAL POURING VESSELS

[75] Inventors: Jan O. Kristiansen, Olmsted Falls; Walter A. McCray, Berea, both of Ohio

[73] Assignee: Foseco Trading A.G., Switzerland

[21] Appl. No.: 122,758

[22] Filed: Feb. 19, 1980

[30] Foreign Application Priority Data

Feb. 17, 1979 [GB] United Kingdom ..... 05680/79

[51] Int. Cl.[3] ..... C21C 7/00

[52] U.S. Cl. ..... 266/44; 75/53; 75/93 G

[58] Field of Search ..... 75/60, 53, 58, 93 G; 266/44

[56] References Cited

U.S. PATENT DOCUMENTS

| | | | |
|---|---|---|---|
| 3,960,546 | 6/1976 | Rote | 75/60 |
| 4,043,798 | 8/1977 | Nashiwa | 75/53 |
| 4,165,065 | 8/1979 | Bowden | 266/44 |
| 4,174,962 | 11/1979 | Frantzreb | 75/53 |
| 4,175,918 | 11/1979 | Frantzreb | 75/53 |

*Primary Examiner*—P. D. Rosenberg

*Attorney, Agent, or Firm*—Leydig, Voit, Osann, Mayer & Holt, Ltd.

[57] ABSTRACT

Formation of skull in the nozzle zone (11) of a metallurgical pouring vessel base (8) is inhibited by placing in the nozzle zone (11), while that is horizontal, an elongated container (1) longer than the length of the nozzle zone (11) and extending inside the vessel (8), the container (1) being filled with anti-skulling material (14) and having a hole (3) in its sidewall (2), and moving the vessel (8) into a position with the nozzle zone (11) vertical thereby causing anti-skulling material (14) to pass through the hole (3) into the nozzle zone (11). The invention also provides a container (1) for use in the method. The invention is especially useful for ladles for pouring steel and permits easy application of optimum amount of anti-skulling material.

8 Claims, 4 Drawing Figures

METALLURGICAL POURING VESSELS

This invention concerns metallurgical pouring vessels having closable outlet nozzles and, in particular, the inhibition of skull in the nozzle zone i.e. the space between the inner side of the outlet and the closure means.

Molten steel in a ladle having a closed outlet nozzle tends to cool and solidify in the nozzle zone to form what is known as 'skull' and this may partly or completely block the outlet when the outlet is opened. It is known to try to avoid this problem by putting into the nozzle zone from its inner side and with the ladle upright particulate high melting point matter (known as 'anti-skulling material') before the steel is introduced into the ladle. This, however, for reasons explained below is not entirely satisfactory.

According to the present invention a method of inhibiting the formation of skull in the nozzle zone of a metallurgical pouring vessel having an outlet nozzle comprises placing in the nozzle zone, whilst the vessel is in a non-vertical position, an elongated container longer than the length of the nozzle zone and extending into the inside of the vessel, the container being filled with loose anti-skulling material and having at least one hole in a sidewall, and moving the vessel into an upright position, thereby causing or allowing anti-skulling material in the container to pass through the at least one hole into that part of the nozzle zone not occupied by the container.

The use of the container greatly assists in positioning the anti-skulling material where it is desired and also aids the provision of the optimum amount of the material. In the known method outlined above it is difficult to position the material correctly and there is a risk of the nozzle zone being provided with insufficient material for the purpose or excess material being supplied and therefore wasted. Furthermore, the use of the container enables the material to be kept dry, as is preferred, whereas in the known method the moisture content of material taken from a bulk supply may be undesirably high and heating may be necessary to reduce the moisture content to a tolerable level.

In the present method it is greatly preferred to place the container in the nozzle zone from the outer side of the vessel and this is done with the outlet open, the outlet being closed before the vessel is moved into the upright, use position. In the known method this convenient way of putting loose anti-skulling material in position is not practicable as the material would not remain in the nozzle zone with the outlet open: instead the material has to be applied from the inner side of the nozzle zone, with the outlet closed, which involves difficulty and danger in that a workman has, for example, to climb a ladder to the top, e.g. 5 m above the base, of the usually hot ladle to apply the material.

The present method is applicable in any case where the means for closing the nozzle is at the outlet side of the nozzle zone. The method is particularly useful where the closure means is a sliding gate valve, either linearly reciprocating or rotary, the outlet nozzles of ladles, and also tundishes, commonly being provided at the outer side of the nozzle zone with such valves as the closure means. The container is placed in the nozzle zone when the pouring vessel is on its side (rather than upright) as is usually the case when, for example, the plates of slide gate valves are changed between completing of a pour from the vessel and the vessel again being filled with molten metal. Preferably the container is inserted when the sliding plate has been removed.

The container is preferably of closed, generally tubular form, having an outside diameter slightly less than the nominal minimum inside diameter of the nozzle and nozzle zone and preferably substantially longer e.g. about twice as long as the length of the nozzle zone from the inside base of the vessel to the closure means for the nozzle. By these relative sizes it can be ensured that sufficient anti-skulling material is present in the container to fill the space between the walls of the nozzle zone and that part of the container in the nozzle zone. Thus, the nozzle zone is completely filled, partly by anti-skulling material in the container in the nozzle zone and partly by anti-skulling material released from the container to the space between it and the rest of the nozzle zone.

The container is preferably in the form of a tube having at least one covered slot or other hole in its side wall and a cap or other closure means at each end. The cover of the hole is removed before use or may be left in place if it is of readily heat-destructible material that is destroyed in situ by the heat of the vessel, or by heat supplied to pre-heat the vessel before the melt is charged to it, to expose the hole. The hole permits release of anti-skulling material in the container into the nozzle zone when the container is in an upright position and the cover has been removed or destroyed. Thus, the container may be put into the nozzle zone when the vessel is positioned such that the nozzle zone is substantially horizontal and, when the vessel is moved to the upright position with the nozzle zone substantially vertical, some of the material in the container falls through the hole, after removal or destruction of the cover, to fill the space between the walls of the nozzle zone and the container.

Preferably the hole is in the form of a slot extending from end to end of the container as this assists squeezing the container past any obstruction in the nozzle or nozzle zone and assists ready release of the anti-skulling material.

The container may be put into the nozzle zone when the latter is still very hot, shortly after completion of a pouring operation, and in this case the side wall of the container should be of a material, preferably a metal e.g. steel, able to survive the high temperature although it should not, in any event, survive the higher temperature of the molten metal e.g. steel during use.

The cap or other closure means for the end of the container destined to be adjacent to the closure means for the vessel outlet should be removed before the vessel, with the container in the nozzle zone is moved to an upright position, or, in the case of a hot vessel or one that is pre-heated, should be of readily heat-destructible material so that it is destroyed by the heat of the vessel or the pre-heating heat. The closure means for the other end of the container may be left in place but, if so, should be of a material destroyed by the heat of the molten metal to be charged to the vessel or at lower temperatures.

The fact that the container is initially closed prevents loss of the anti-skulling material during storage and transport of the container and prevents contamination of the material e.g. by moisture.

According to the invention a container for use in the method of the invention comprises a tube, closed at both ends and filled with anti-skulling material, having in its side wall at least one covered hole, the cover being removable and/or of a readily heat destructible material.

A further aspect of the invention is a method of pouring molten metal using a vessel having an outlet nozzle with a nozzle zone provided with a container in accordance with the invention.

The anti-skulling material is a refractory particulate material: it should be infusible at the temperature of the molten metal which will contact it. Suitable materials include sands such as silica and zircon sands and particulate carbon. Preferably the material has marked free-flowing properties.

The invention is further described with reference to the accompanying drawings in which.

Figure 1:
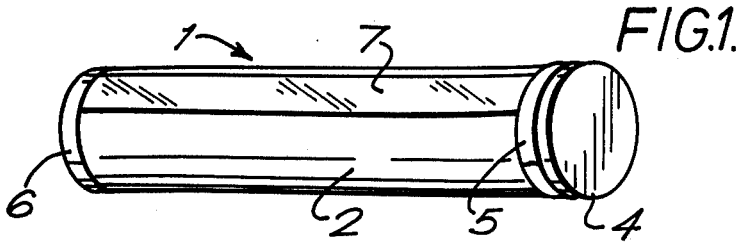
FIG. 1 is a view of a container according to the invention.
Figure 2:
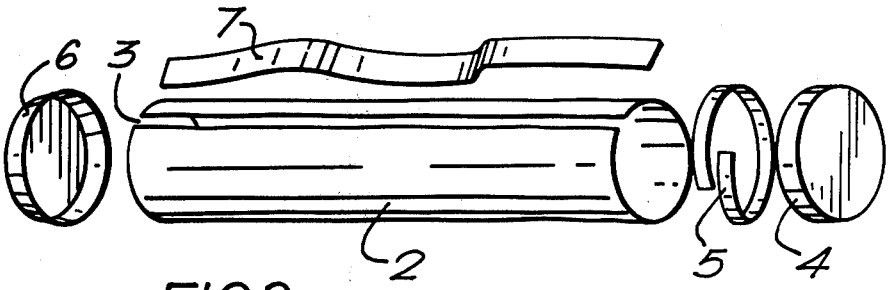
FIG. 2 is an exploded view corresponding to FIG. 1.

Referring to FIGS. 1 and 2, a tubular container 1 comprises a steel sidewall 2 rolled up so that the sides are spaced slightly apart to define a slot 3 extending from end to end of the tube. At one end the container has a cap 4 of readily heat-destructible material e.g. plastics material held partly within the tube by adhesive tape 5. At the other end the container has a heat-destructible cover 6 e.g. of plastics material. The slot 3 has a removable cover in the form of adhesive tape 7. Within the container is dry, particulate anti-skulling material (not shown).

Figure 3:
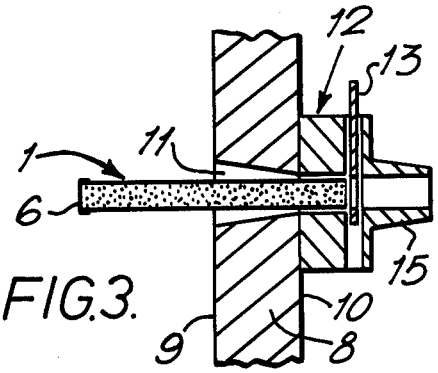
FIG. 3 is a diagrammatic section (drawn to a much reduced scale compared with FIGS. 1 and 2) through part of the base of a ladle on its side so that the nozzle zone is horizontal and FIG. 4 is a diagrammatic section as in FIG. 3 but showing the ladle in the upright position.
Figure 4:
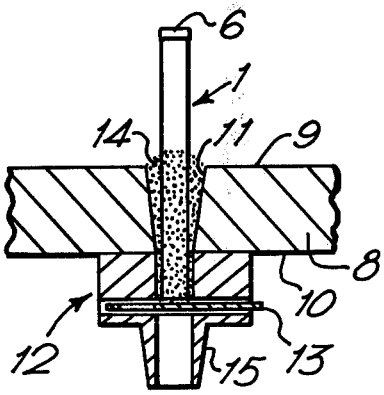

Referring to FIGS. 3 and 4 the base 8 of the ladle has an inside face 9 and an outside face 10 and through the base there is a nozzle zone 11. The nozzle zone 11 continues within a slide gate valve assembly 12 having a slidable plate 13 and at the outer side of the assembly is a nozzle 15. Within the nozzle zone is a container 1 as described with reference to FIGS. 1 and 2 but with the adhesive tape 7 removed and the slot 3 uppermost in the case of FIG. 3.

In FIG. 3 the slidable plate 13 is so positioned that the nozzle is open i.e. the nozzle zone is accessible from the outside of the slide gate valve assembly whereas in FIG. 4 it is so positioned that the nozzle is closed. In FIG. 4 anti-skulling material released through the slot from the container into the nozzle zone is shown at 14.

In use, the tape 7 is removed from the container in the horizontal position with the slot 3 uppermost, the cap 4 also removed and the container is then inserted into the nozzle zone 11, whilst that is horizontal, from the outer side with the cap 6 in position and leading. Alternatively, if the ladle is hot enough to destroy the tape 7 or is pre-heated to a sufficient temperature, the tape 7 may be left in place and destroyed in situ by the heat of the ladle or the pre-heating heat and the same applies to the cap 4 if there is sufficient heat to destroy that. The container is pushed sufficiently far into the nozzle zone as to clear the position of slidable plate 13 as shown in FIG. 3. The nozzle is then closed by sliding of the slidable plate and the ladle moved into the upright position as shown in FIG. 4. This movement causes some of the anti-skulling material to fall through the slot into the nozzle zone so as to fill the space between the walls of the nozzle zone and the container as shown in FIG. 4.

The ladle is subsequently filled with molten metal e.g. steel and, when the nozzle is opened by movement of the slidable plate, the anti-skulling material passes through the nozzle together with the residue from the container left by the action of the molten metal. The formation of any skull in the nozzle zone requiring removal before the molten metal is poured from the ladle through the nozzle is prevented.

The invention is exemplified by the following Examples:

EXAMPLE 1

A tubular container as described with reference to FIGS. 1 and 2 having a length of 588 mm and an outside diameter of 86 mm and made of steel was inserted, with the tape 7 removed and the slot 3 uppermost from the outside and in horizontal position into the nozzle zone also horizontal, of a 300 tonne capacity steel pouring ladle, the vessel having a slide gate valve assembly for the nozzle. The temperature of the nozzle zone was about 1100° C. and before insertion of the container the slidable plate of the valve assembly had been removed. After insertion of the container the valve assembly was fitted with a slidable plate and this was moved to close the nozzle. The ladle was then moved into the upright position, filled with molten steel and 30 minutes later was used for pouring the steel. On opening the slide gate valve the anti-skulling material and residue from the container passed through the nozzle followed by the molten metal and there was no skull in the nozzle zone requiring removal e.g. by oxygen lancing, before the molten metal would flow through the nozzle.

EXAMPLE 2

Example 1 was repeated except that the ladle was initially cold and after insertion of the container it was heated for 3.5 hours, with the nozzle still horizontal, until it had a dull red colour. When the ladle was ready for pouring there was, again, no skull in the nozzle zone requiring removal.

EXAMPLE 3

Example 1 was repeated except that after filling the ladle with molten steel the steel was stirred with argon for 5 minutes before the 30 minutes holding period. Once again no skull in the nozzle zone requiring removal was formed.

We claim:

1. A method of inhibiting the formation of skull in the nozzle zone of a metallurgical pouring vessel having a closable outlet nozzle comprising placing in the nozzle zone, whilst the vessel is in a generally horizontal, out of use position, an elongated container longer than the length of the nozzle zone and extending into the inside of the vessel, the container being filled with loose anti-skulling material and having at least one hole in a sidewall, and moving the vessel into an upright position thereby causing or allowing anti-skulling material in the container to pass through the at least one hole into that part of the nozzle zone not occupied by the container.

2. A method according to claim 1 in which the container is put into the nozzle zone from the outside of the vessel and the outlet nozzle is then closed before the vessel is moved into the upright position.

3. A method according to claim 1 in which the container is of generally tubular form and has an outside diameter slightly less than the minimum inside diameter of the nozzle and nozzle zone.

4. Means for inhibiting the formation of skull in the nozzle zone of a metallurgical pouring vessel having a closable outlet nozzle, comprising a tubular container, closed at both ends and filled with loose anti-skulling material, having in its sidewall at least one covered hole, the cover being removable and/or formed of a readily heat-destructible material.

5. Means according to claim 4 in which there is a single hole in the sidewall, this hole being in the form of a slot extruding from end to end of the container.

6. Means according to claim 4 in which the sidewall of the container is of steel and the container has a removable and/or readily heat-destructible cap at one end.

7. A method according to claim 1 in which said hole in the sidewall of said container is covered by a material that is destructible by the heat within said vessel before molten metal is charged thereto.

8. Means according to claim 4 in which said cover is destructible by the heat within said vessel before molten metal is charged thereto.

* * * * *